US006345454B1

(12) United States Patent
Cotton

(10) Patent No.: US 6,345,454 B1
(45) Date of Patent: Feb. 12, 2002

(54) SHOE HAVING A REMOVABLE SOLE AND METHOD OF USE

(76) Inventor: Johnny Carmichael Cotton, 15136 Versailles St., Lake Elsinore, CA (US) 92530

( * ) Notice: Subject to any disclaimer, the term of this patent is extended or adjusted under 35 U.S.C. 154(b) by 0 days.

(21) Appl. No.: 09/585,342

(22) Filed: Jun. 2, 2000

(51) Int. Cl.[7] ..... A43B 3/24
(52) U.S. Cl. ..... 36/101; 36/15; 36/36 R
(58) Field of Search ..... 36/15, 100, 101, 36/36 R, 62

(56) References Cited

U.S. PATENT DOCUMENTS 2,878,595 A * 3/1959 Auber ..... 36/36 R
3,538,628 A * 11/1970 Einstein, Jr. ..... 36/15
4,363,177 A * 12/1982 Boros ..... 36/101
5,317,822 A * 6/1994 Johnson ..... 36/101
5,615,497 A * 4/1997 Meschan ..... 36/36 R
5,644,857 A * 7/1997 Ouellette et al. ..... 36/15
5,661,915 A * 9/1997 Smith ..... 36/15

* cited by examiner

*Primary Examiner*—Paul T. Sewell
*Assistant Examiner*—Troy Arnold
(74) *Attorney, Agent, or Firm*—Timothy Thut Tyson; Ted Masters; Freilich, Hornbaker & Rosen

(57) ABSTRACT

A shoe (20) having a removable sole includes an upper (22) and a removable lower sole (34). The upper has an upper sole (24), a heel portion (26), and a toe portion (28). Upper sole (24) has a plurality of upwardly opening alignment holes (30). A lock tab (32) is connected to toe portion (28) and forwardly projects therefrom. The removable lower sole (34) has a heel portion (36) and a toe portion (38). A rearwardly opening slot (40) disposed in toe portion (38) is shaped and dimensioned to receive lock tab (32). Removable lower sole (34) has a plurality of upwardly protruding alignment pins (42) which are engageable with alignment holes (30) in upper sole (24). Lower sole (34) is held in place by inserting lock tab (32) into the rearwardly opening slot (40) in the toe and engaging connector (44) to connect heel portion (26) of upper (22) to heel portion (36) of lower sole (34).

3 Claims, 2 Drawing Sheets

20
22
24
26
28
30
32
34
36
38
40
42
44
46
46'
(a)
(b)
(c)

SHOE HAVING A REMOVABLE SOLE AND METHOD OF USE

CROSS-REFERENCE TO RELATED APPLICATION

This application claims the filing benefit under 35 U.S.C. §119(e) of U.S. Provisional Application No. 60/142,867, filed Ser. No. 07/08/99, which is included herein by reference.

TECHNICAL FIELD

The present invention pertains generally to footwear, and in particular to a shoe in which the sole portion may be selectively removed and replaced with another sole portion.

BACKGROUND ART

Shoes having replaceable soles are well known in the art. For example, U.S. Pat. No. 4,377,042 shows athletic footwear having a removable sole. Each upper is designed to fit an individual foot and ankle of a particular wearer and such upper is provided with a securely and permanently connected insole. Each insole terminates along its peripheral margin with one part of a bead-and-recess mechanically detachable locking member. A removable outsole is provided with a surface contacting tread which is selected to not only best match the surface of a particular sports area, but also the condition of such surface at a particular time of use. U.S. Pat. No. 5,317,822 illustrates an athletic shoe with interchangeable wear sole which can be selected to match a specific sport. An upper portion of the athletic shoe is designed for an individual foot of a particular wearer. This upper portion of the athletic shoe contains an attached upper sole which has molded on the bottom surface a plurality of strategically placed protruding resilient knobs, and a protruding edge rail which engages knob chambers and a rail slot located on the upper surface of the wear sole. Hook and loop fasteners such as sold under the trademark VELCRO on the upper sole and wear sole also are engaged. Interlocking devices on the edge of the upper sole and wear sole are pinned together. U.S. Pat. No. 5,353,522 defines a shoe having a removable sole portion. The shoe includes an upper and a sole, the sole including at least one fixed sole portion which fixed sole portion is fixedly attached to the upper. At least one removable sole portion is movable between a first position substantially adjacent to the fixed sole portion and a second position substantially separated from the fixed portion, the removable sole portion extending across the longitudinal axis of the shoe. A hinge apparatus provides a pivotal movement between the shoe and the removable sole portion, whereby the removable sole portion may be moved to the second position to provide access to the interior of the shoe without removal of the shoe from the foot of the wearer. U.S. Pat. No. 5,410,821 discloses a shoe with interchangeable soles. The invention is a sport shoe having a shoe upper with an interior for receiving a human foot and a bottom surface formed thereon, a removable foresole attached to a forward portion of the bottom surface of the shoe upper and having a toe receptacle for fitting against the toe area of the shoe upper, and a strap fastened to one side of the removable foresole and extending over the toe area of the shoe upper so as to removably fasten the foresole to the bottom side of the shoe upper. U.S. Pat. No. 5,615,497 portrays an improved athletic shoe sole with rotatable and replaceable cleats to provide the user with longer wear. The invention also provides the user with the ability to quickly and easily adapt the sole to different desired performance characteristics depending upon the intended activity and terrain or playing surface. U.S. Pat. No. 5,727,334 comprises a safety shoe with high-traction replaceable sole. A shoe having a replaceable sole pad for use by roofers is provided wherein the shoe has a thin lower flexible portion with a sheet or layer of hook fasteners of the hook-and-loop type fastener system disposed on a bottom surface thereof, and wherein a replaceable sole pad is provided having a sheet or layer of the corresponding loop elements provided on the upper surface thereof. The sole pad is constructed of high density, closed-cell foam that provides greatly improved traction on roofing surfaces, thereby improving worker safety, productivity and efficiency, and provides adequate durability to make the shoe with the replaceable soles cost justifiable.

DISCLOSURE OF INVENTION

The present invention is directed to a shoe which has an upper designed to fit the foot of a wearer, and a removable lower sole attached to the bottom of the upper. The upper can be fabricated from any conventional footwear material such as leather or canvas in sports, work shoe, dress shoe, and everyday shoe styles. A plurality of interchangeable removable lower soles can be selectively attached to the upper. The lower soles can be suited for a specific activity or sport such as football, baseball, track, hiking, and golf or for general walking. The lower soles can be fabricated from rubber, leather, or plastic, and can contain different bottom configurations such as cleats, spikes, ridges, and grooves or be flat.

The present invention allows the wearer to quickly and easily change the soles on his or her shoes to meet specific needs. The present shoe is ideally suited for those wearers who participate in a number of different indoor and outdoor activities or sports, allowing the same uppers to be used with a number of different removable lower soles, thereby eliminating the need to purchase multiple pairs of expensive shoes.

The present invention provides for the rapid changing of removable lower soles. Only one connector is used to effect the changing of lower soles.

In a preferred embodiment of the invention, a shoe comprises an upper having an upper sole, a heel portion, and a toe portion. The bottom of the upper sole has a plurality of upwardly opening alignment holes. A lock tab is connected to the toe portion and forwardly projects therefrom. A removable lower sole has a heel portion and a toe portion. A rearwardly opening slot is disposed in the toe portion, and is shaped and dimensioned to receive the lock tab. The removable lower sole has a plurality of upwardly protruding alignment pins that are engageable with the alignment holes in the upper sole. A connector selectively connects the heel portion of the upper to the heel portion of the removable lower sole.

In accordance with an important aspect of the invention, the connector includes a pivotable latch disposed upon the heel portion of the upper, and a cooperating bracket disposed upon the heel portion of the removable lower sole.

In accordance with an important feature of the invention, a plurality of removable lower soles are provided, each of the soles having a different bottom configuration.

Other features and advantages of the present invention will become apparent from the following detailed description, taken in conjunction with the accompanying drawings, which illustrate, by way of example, the principles of the invention.

MODES FOR CARRYING OUT THE INVENTION

Figures 1, 2:
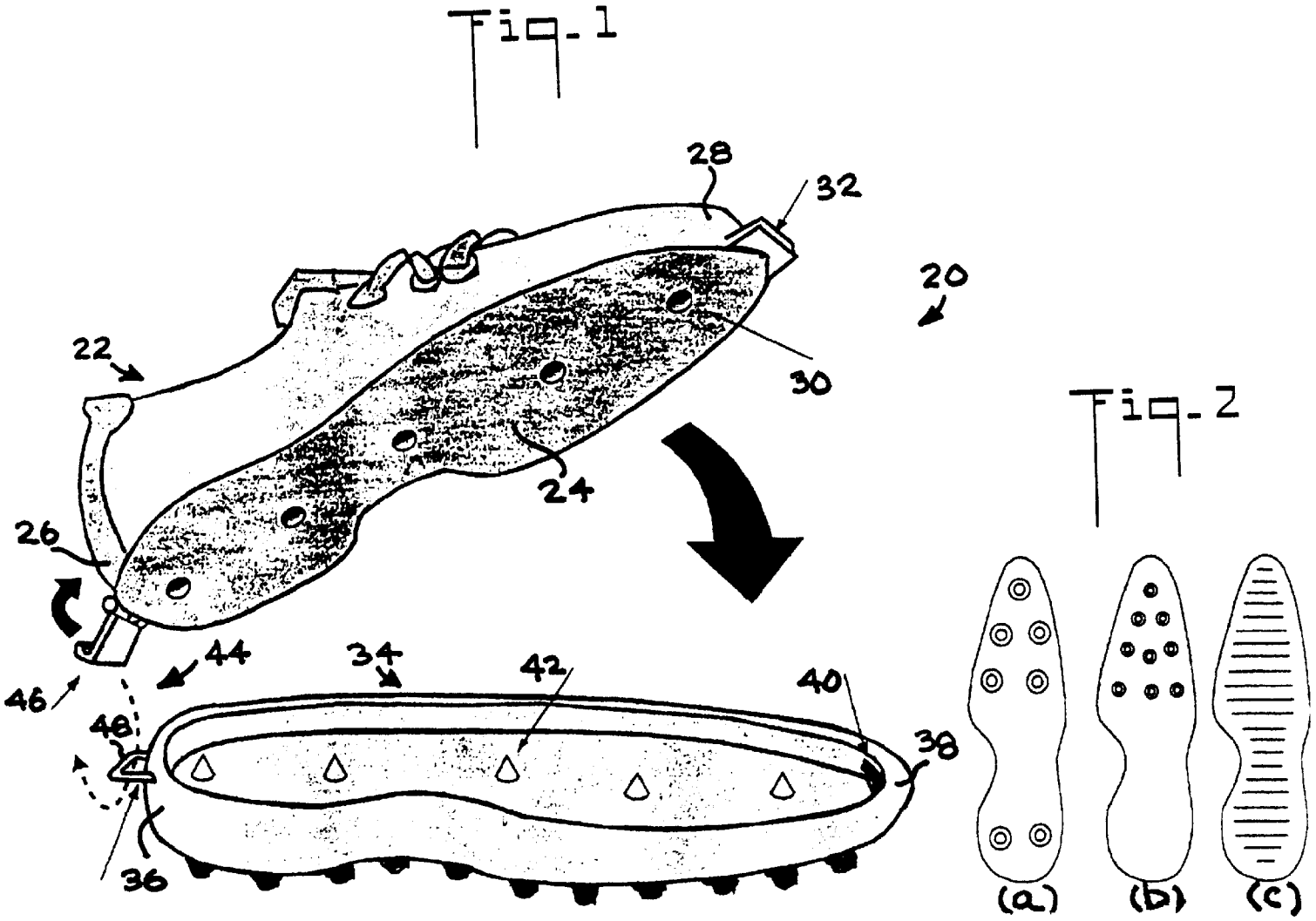
FIG. 1 is a perspective view of a shoe with a removable sole, in accordance with the present invention.
FIG. 2 is a bottom plan view of various removable lower sole embodiments; and, FIG. 3 is a fragmented cross sectional side elevation view of the shoe.

Referring initially to FIG. 1, there is illustrated a perspective view of a shoe with a removable sole, in accordance with the present invention, generally designated as 20. Shoe 20 includes an upper 22 having an upper sole 24, a heel portion 26, and a toe portion 28. Upper sole 24 has a plurality of upwardly opening alignment holes 30. A lock tab 32 is connected to toe portion 28 and forwardly projects therefrom.

A removable lower sole 34 has a heel portion 36 and a toe portion 38. A rearwardly opening slot 40 disposed in toe portion 38, and is shaped and dimensioned to receive lock tab 32. Removable lower sole 34 has a plurality of upwardly protruding alignment pins 42 which are engageable with alignment holes 30 in upper sole 24. A connector 44 selectively connects heel portion 26 of upper 22 to heel portion 36 of removable lower sole 34. In a preferred embodiment, connector 44 includes a pivotable latch 46 disposed upon heel portion 26 of upper 22, and a cooperating bracket 48 disposed upon heel portion 36 of removable lower sole 34.

It may be appreciated that alignment holes 30 could be located on the upper surface of removable lower sole 34, and alignment pins 42 could be located on the bottom surface of upper sole 24.

While the preferred connector 44 is the shown latch 46 and bracket 48, other types of connecting means such as zippers or hook and loop fasteners could also be utilized. Also, connectors disposed on the side of the shoe could be used.

FIG. 2 is a bottom plan view of various removable lower sole 34 embodiments. A plurality of removable lower soles 34 are depicted, each of the plurality having a different bottom configuration. That is, (a) is for football, (b) is for track, and (c) is for ice. It may be appreciated that numerous other removable lower soles could also be utilized whether for specialized sports or work use or general walking.

Figure 3:
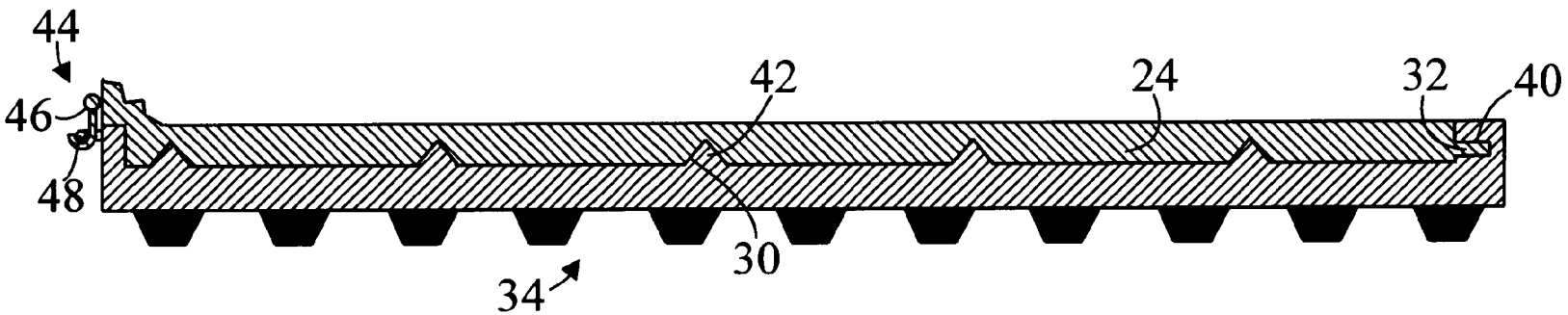

FIG. 3 is a fragmented cross sectional view of shoe 20. Connector 44 is shown in the closed position thereby connecting upper sole 24 to lower sole 34. Lock tab 32 is shown inserted in slot 40. And alignment pins 42 are shown engaging alignment holes 30.

In terms of use, the method for installing the removable lower sole 34 of the present invention comprises:

inserting lock tab 32 into slot 40;

inserting alignment pins 42 into alignment holes 30; and, using connector 44 to connect heel portion 26 of upper 22 to heel portion 36 of removable lower sole 34.

It is also noted that the method for removing the removable lower sole 34 simply comprises disengaging connector 44 and removing lock tab 32 from slot 40.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A shoe, comprising:

an upper having:
- an upper sole, a heel portion, and a toe portion;
- said upper sole having a plurality of upwardly opening alignment holes; and,
- a lock tab connected to said toe portion and forwardly projecting therefrom;

a removable lower sole having:
- a heel portion and a toe portion;
- said toe portion having an inner edge;
- said toe portion having a rearwardly opening slot, said slot disposed on said inner edge of said toe portion of said removable lower sole, said slot shaped and dimensioned to receive said lock tab; and,
- a plurality of upwardly protruding alignment pins, said alignment pins engageable with said alignment holes in said upper sole; and, a connector for selectively connecting said heel portion of said upper to said heel portion of said removable lower sole.

2. A shoe according to claim 1, further including:

said connector including a pivotable latch disposed upon said heel portion of said upper, and a cooperating bracket disposed upon said heel portion of said removable lower sole.

3. A shoe according to claim 1, farther including:

a plurality of said removable lower soles, each of said plurality having a different bottom configuration.

* * * * *